US005492297A

United States Patent [19]

Underwood

[11] Patent Number: 5,492,297

[45] Date of Patent: Feb. 20, 1996

[54] TENSION CLAMP HANGER

[76] Inventor: Thomas F. Underwood, 6623 Todd St., Fort Hood, Tex. 76544

[21] Appl. No.: 308,575

[22] Filed: Sep. 19, 1994

[51] Int. Cl.[6] ..... B42F 13/00

[52] U.S. Cl. ..... 248/340; 248/215; 248/303; 248/692

[58] Field of Search ..... 248/214, 215, 248/340, 227, 303, 304, 339, 692; 24/8, 716

[56] References Cited

U.S. PATENT DOCUMENTS

| | | | |
|---|---|---|---|
| 19,046 | 4/1889 | Williamson | 248/215 X |
| 202,202 | 4/1878 | Thompson | 24/8 |
| 823,704 | 6/1906 | Simpson | 24/8 |
| 841,945 | 1/1907 | Doughty | 248/339 |
| 1,286,940 | 12/1918 | Cerny | 248/340 X |
| 1,294,617 | 2/1919 | Cartisser | 24/716 X |
| 1,361,056 | 12/1920 | Hickman | 248/215 |
| 2,246,229 | 6/1941 | Wohlmuth | 248/340 X |
| 3,329,386 | 7/1967 | Rosen | 248/340 |

FOREIGN PATENT DOCUMENTS

| | | | |
|---|---|---|---|
| 446091 | 4/1936 | United Kingdom | 24/716 |

*Primary Examiner*—J. Franklin Foss

[57] ABSTRACT

A tension clamp hanger which acts to suspend flexible articles or objects within a flexible container, from a support. The hanger has a rigid, vertical shank with a hook at the upper end and a generally horizontal lower end which is separated into two opposing halves. In use, the hook portion of the hanger is engaged with the support, such as a rod or tree, to suspend the hanger. A flexible portion of the article or container to be suspended is looped around the rigid, vertical shank of the hanger to completely encircle the shank, and after crossing the flexible portion back over itself, the flexible portion is placed in between the opposing parts of the lower end. The tension clamp hanger then acts to grip the article or container more tightly as the article is pulled in a downward direction. The article is easily released, however, by simply pulling the article up and away from the lower end of the hanger. Rope, cord, chains, or other objects tied to flexible portions of these articles may also be suspended using the tension clamp hanger in the described manner.

11 Claims, 3 Drawing Sheets

TENSION CLAMP HANGER

BACKGROUND OF THE INVENTION

The present invention relates to an apparatus for suspension of flexible articles, or objects connected to a flexible article, from a support. More specifically, the tension clamp hanger described herein provides a mechanism whereby flexible articles may be suspended from a support in such a manner that their own weight or any application of force in a downward direction upon them will tend to bind them more tightly to the tension clamp hanger.

SUMMARY OF THE INVENTION

It is the main object of the present invention to provide an improved tension clamp hanger.

It is an object of the present invention to provide the user with an effective means of suspending flexible articles from a support.

Another object of the invention is to provide a tension clamp hanger whereby the suspended article can be easily released therefrom.

A further object of the invention is to provide the user with a tension clamp hanger which positively engages the article to be suspended from a support and prevents the article from being disengaged when subjected to its own weight or ordinary downward pulling forces.

Yet another object of the invention is to provide an economically manufactured and simple hanger of sound construction, which will be both efficient and practical in use.

A still further object of the present invention is to provide a means for suspension of objects which are connected to flexible articles such as chain, rope, or string.

Another object of the invention is to provide a tension clamp hanger with a hook end that allows suspension of flexible articles from a support.

A further object of the invention is to provide a tension clamp hanger with a vertical and rigid shank member which allows the suspension of flexible articles at some distance below the desired support.

A further object of the invention is to provide a tension clamp hanger with a lower end which provides for engagement of flexible articles and prevents disengagement when subjected to ordinary downward pulling forces or the weight of the flexible article itself.

A still further object of the present invention is to provide a tension clamp hanger which may be fabricated from spring wire or some other material such as plastic which has the characteristic of resiliency and is resistent to cracking and/or fracturing.

It is an object of the present invention to provide a tension clamp hanger which may be manufactured in various sizes so as to accommodate larger or smaller flexible articles more effectively.

These and other objects of the instant invention will become more apparent hereinafter. The instant invention will now be described with particular reference to the accompanying drawings that form a part of the specification.

DESCRIPTION OF THE PREFERRED EMBODIMENT

Figure 1:
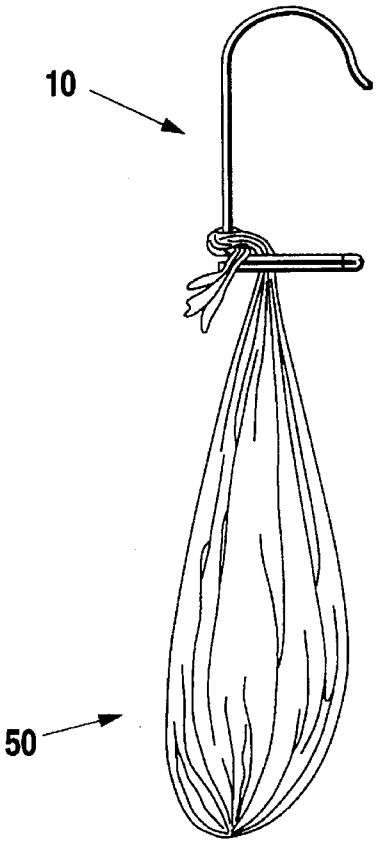
FIG. 1 is a side view of a typical flexible article such as a bag suspended from and attached to the present invention.

Referring now to FIG. 1 of the drawings, there is shown, represented generally by the numeral 10, a pictorial view of the tension clamp hanger along with a typical flexible article, herein represented by a plastic bag 50, and suspended from the tension clamp hanger 10. The tension clamp hanger 10 is shown in FIG. 1 in a side view.

Figure 2:
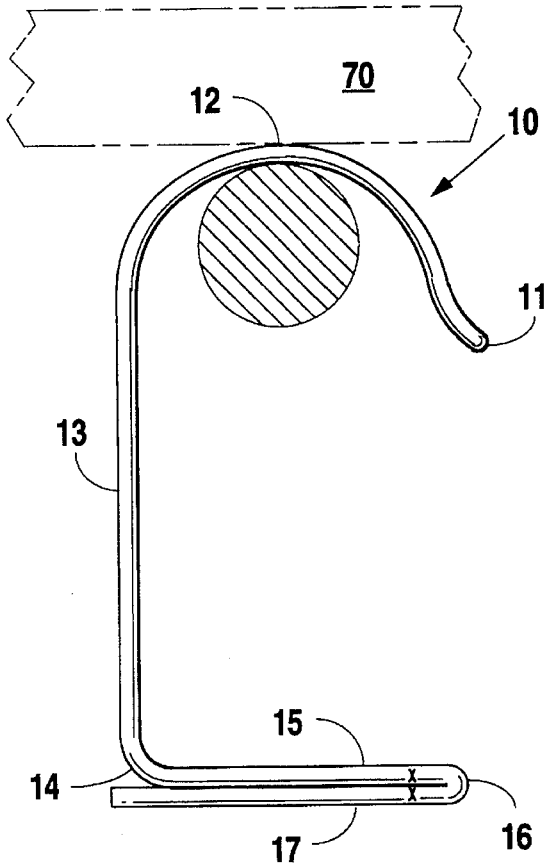
FIG. 2 is a close-up side view of the tension clamp hanger.

Referring now to FIG. 2, there is shown a side view of the tension clamp hanger 10 suspended from a support indicated generally by reference numeral 60 and beneath an overhead object indicated generally by reference numeral 70. The tension clamp hanger 10 is formed from a single piece of spring wire which is folded in half back upon itself so as to form a hook end 11 at the bend. The wire is bent into a"J"-shaped form, with the maximum curvature located at point 12 so as to suspend from the support 60. The tension clamp hanger 10 extends in a downward direction for approximately three inches so as to form a shank 13. At transition point 14, the tension clamp hanger 10 bends so as to form a lower end 15 extending in a perpendicular direction away from shank 13 and generally in the same plane as hook end 11. Lower end 15 is further defined by reversal bend 16 which occurs at a distance approximately two inches from lower end transition 14 and places the backwardly bent wires 17 parallel to the general direction of the lower end 15, but reversing the direction of travel so as to extend back toward lower end transition 14. The backwardly bent wires 17 are then cut off or terminated near lower end transition 14, which completes the basic construction of the tension clamp hanger 10.

The hook end 11 is bent outward to facilitate suspension of the tension clamp hanger 10 from support 60 when there is low clearance between support 60 and overhead object 70, making it difficult to suspend tension clamp hanger 10 when engaged to a heavy object.

Figure 3:
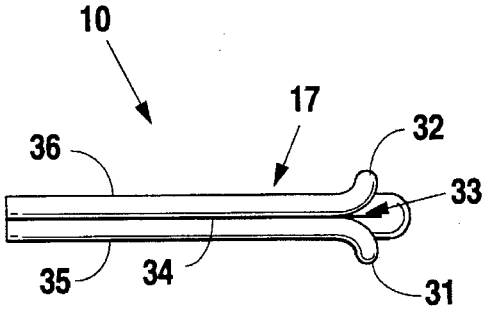
FIG. 3 is a close-up bottom view of the tension clamp hanger.
Figure 4:
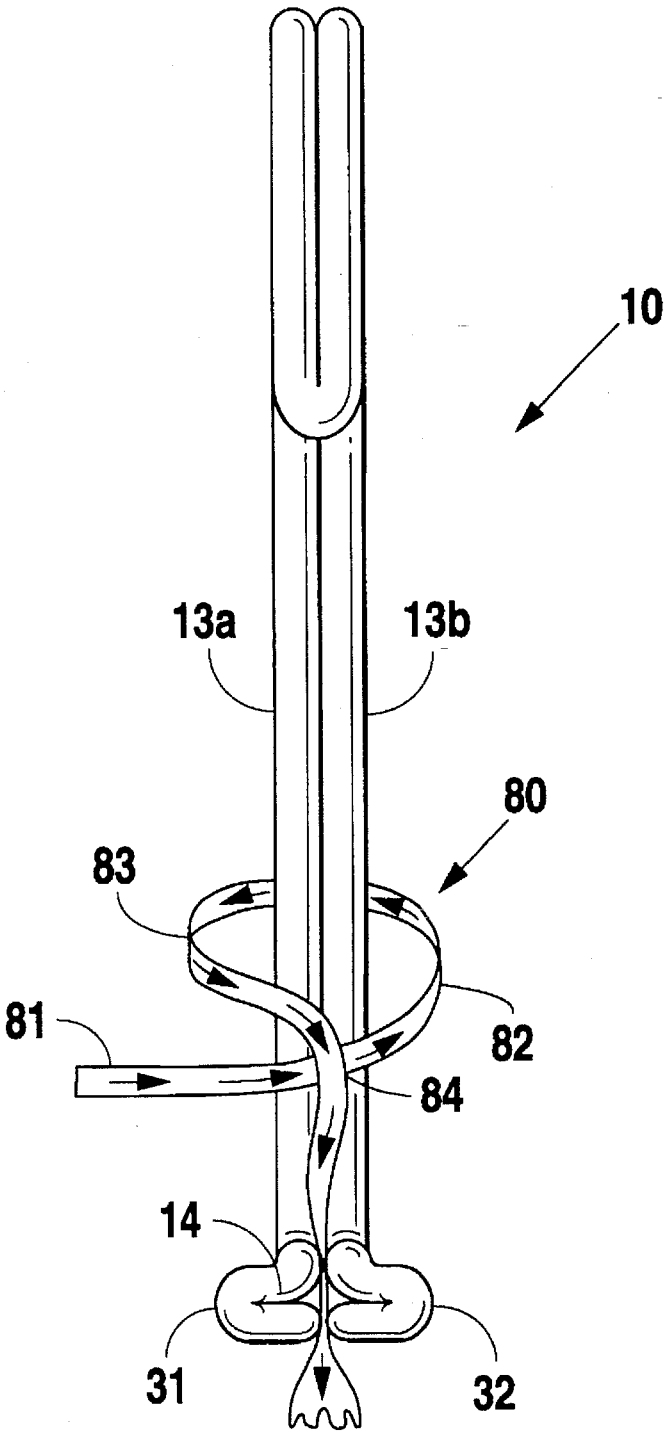
FIG. 4 is a close-up front view of the tension clamp hanger.

Referring now to FIGS. 3 and 4, which show the tension clamp hanger 10 from a bottom and front view, it is shown that, to further facilitate the use of the tension clamp hanger 10, each of the backwardly bent wires 17 can also be bent in an outward direction from the lower end throat 33 so as to form a left lower end tip 31 and a right lower end tip 32, each tip comprising a mirror image of the other. Formation of the lower end tips provides easier engagement of flexible articles.

Left lower end 35 and right lower end 36 may or may not be in physical contact with each other at juncture 34 so as to provide easier suspension of larger flexible objects. Additionally, shank 13 may or may not be divided into shank left side **13*a* and shank right side 13*b*, but may form a single, solid piece. Such division is not necessary to the functionality of the present invention. Likewise, lower end 15 may or may not be bent back upon itself at reversal bend 16**, but may terminate at that point and still result in a functional device.

Figure 5:
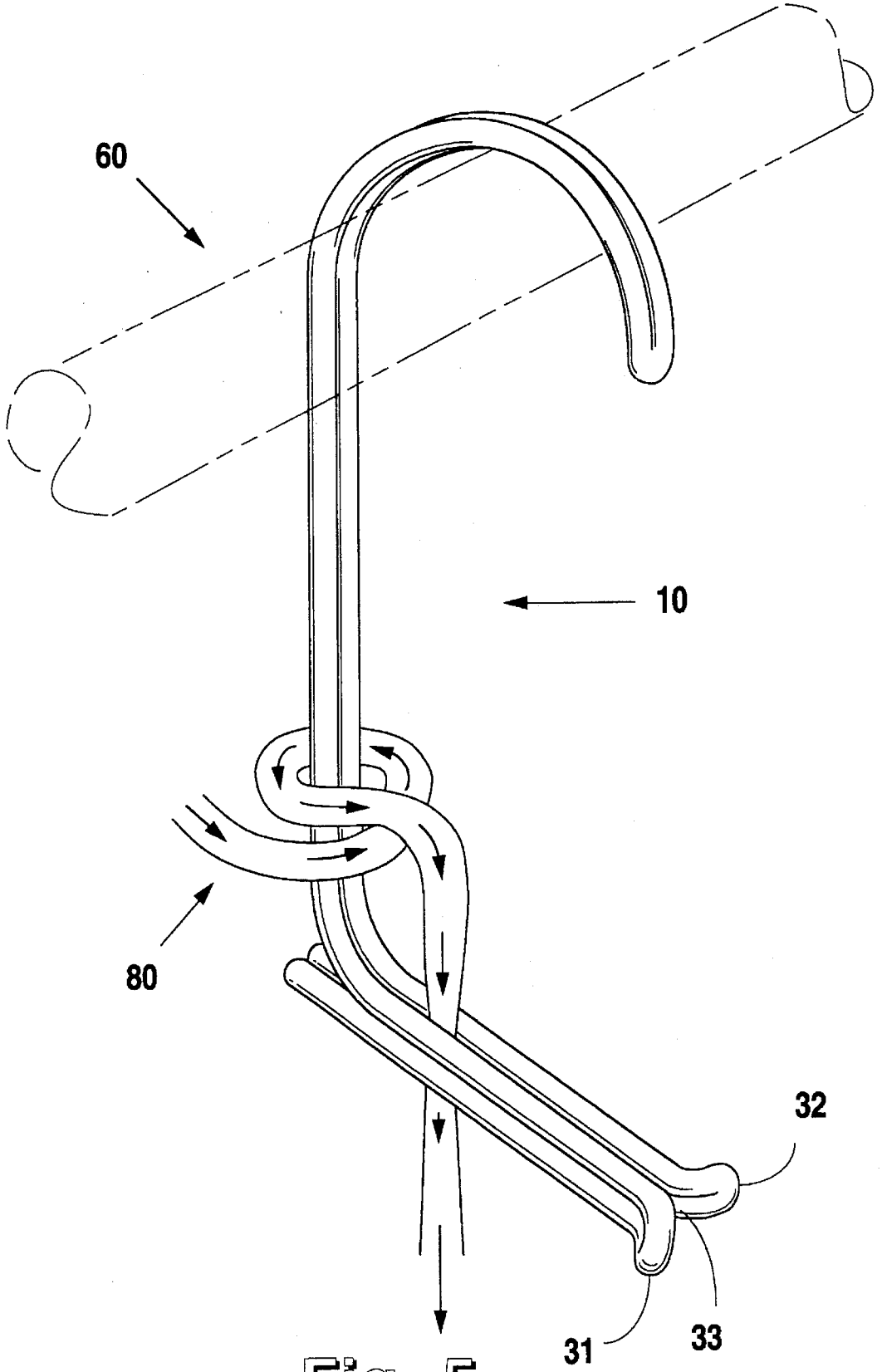
FIG. 5 is a perspective view of the present invention with an indication of one of the methods of its use.

Referring now to FIG. 5, tension clamp hanger 10 can be either suspended from support 60 before engagement with flexible article 80, or can be engaged with flexible article 80 and then suspended from support 60. Assuming that the tension clamp hanger 10 is first suspended from support 60, a flexible article 80, such as rope or string, is engaged with the tension clamp hanger 10 in the following manner. As seen in FIGS. 3 and 4, to engage the article, a portion of the flexible article 80 is laid across the front of shank 13 so that the flexible object upper end 81 extends out and past the left side of shank 13. The balance of the flexible article 80 is then wrapped around the shank 13 so as to cross over the front of shank 13 and go behind shank 13 to form a flexible object first bend 82. The flexible object 80 is then further curved around the shank 13 so as to form a flexible object second bend 83 and cross back over flexible object upper end 81 at a point generally located near lower end transition 14 and occurring at flexible object crossover 84. Flexible object 80 is then placed at lower end throat 33 and pulled in between left lower end tip 31 and right lower end tip 32 so as to be firmly clamped between left lower end 35 and right lower end 36. Flexible object 80 is then pulled tightly in a downward direction so as to firmly engage the flexible object 80 with the tension clamp hanger 10. Engagement occurs because the flexible object 80 is drawn against itself at the flexible object crossover 84 and by means of friction at that point. The flexible object upper end 81 is forced tightly between the lower end transition 14 and the flexible object crossover point 84, thereby preventing any further downward motion of flexible object 80.

Referring now to FIG. 5, a perspective view of the process for engagement of the flexible object 80 with the tension clamp hanger 10 is further illustrated.

Forms of the invention other than the"J"-shaped hook which is illustrated in FIG. 1 and FIG. 5 can be utilized, depending upon the shape of the support 60 from which the tension clamp hanger 10 is to be suspended.

Instead of spring wire, other types of materials may be used for the construction of the present invention. This would include wire which is not of a spring nature as well as plastics or other semi-rigid materials. Whatever material is used, it must have the characteristic of resiliency and, additionally, it must be resistent to cracking and/or fracturing. Likewise, the size of the tension clamp hanger 10 may be increased or decreased from those general dimensions noted previously as required for suspension of larger or smaller flexible articles.

While the invention has been described in its preferred embodiment, it is to be understood that words that have been used are words of description rather than limitation and that changes may be made within the purview of the appended claims without departing from the full scope of the invention. Having thus described my invention,

I claim:

1. A tension clamp hanger for hanging articles from a supporting member by an upper flexible end of the articles, said tension clamp hanger comprising:

a generally vertical and rigid shank member;

a hook upper end of said generally vertical and rigid shank member, said hook upper end engaging and being suspended by said supporting member; and a lower end of said generally vertical and rigid shank member, said lower end having a first half and second half pressing against each other for a horizontal distance and thereafter angling apart at a common terminal end below said hook upper end so that said upper flexible end of one of said articles may be looped over said lower end, around said generally vertical and rigid shank and back over said lower end and a portion of said upper flexible end and thereafter downward, said portion of said upper flexible end passing between said first half and said second half, weight of one of said articles pulling said upper flexible end into tight engagement with said generally vertical and rigid shank member and said lower end to suspend one of said articles therebelow.

2. A tension clamp hanger for hanging an article from a supporting member by an upper flexible end of the article, said tension clamp hanger comprising:

a generally vertical and rigid shank member;

a hook upper end of said generally vertical and rigid shank suspended by said supporting member;

a lower end of said generally vertical and rigid shank member, said lower end comprising a first half and a second half, said first and second halves pressing against each other for a horizontal distance and thereafter angling apart at a terminal end so that said flexible end of said article may be looped over said lower end, around said generally vertical and rigid shank member, and disposed between said first half and said second half so as to suspend said article.

3. The tension clamp hanger of claim 2 wherein said generally vertical and rigid shank member is divided into opposing halves pressing together.

4. The tension clamp hanger of claim 2 wherein said hook upper end is divided into opposing halves pressing together.

5. The tension clamp hanger of claim 2 wherein said generally vertical and rigid shank member and said hook upper end are divided into opposing halves pressing together.

6. A method of suspending an article from a supporting by a hanger comprising the following steps:

engaging a hook upper end of said hanger with said supporting structure to suspend said hanger therebelow;

looping a flexible upper end of said article over a lower generally horizontal end of said hanger and around a generally vertical and rigid shank of said hanger so that said flexible upper end of said article crosses back over a portion of said flexible upper end; and extending said flexible upper end of said article downward between opposing halves of said lower generally horizontal end pressing together to suspend said article therebelow.

7. The method of claim 6 wherein the weight of said article pulls said upper flexible end into tight engagement with said generally vertical and rigid shank member and said lower generally horizontal end to more securely suspend said article.

8. The method of claim 6 wherein said flexible upper end engages with and suspends a second article.

9. The method of claim 8 wherein the weight of said second article pulls said upper flexible end into tight engagement with said generally vertical, rigid shank member and said lower generally horizontal end to more securely suspend said second article.

10. A method of suspending a flexible article from a supporting structure by a hanger comprising the following steps:

engaging a hooked upper end of said hanger with said supporting member so as to suspend said hanger therebelow;

locating a flexible end of said flexible article between opposing first and second halves of a lower generally horizontal end of said hanger;

looping said flexible end of said flexible article over said lower generally horizontal end and around a generally vertical and rigid shank member of said hanger; and locating a portion of said flexible end of said flexible article between said opposing first and second halves so as to suspend said flexible article.

11. A method of suspending a flexible article from a supporting structure by a hanger comprising the following steps:

engaging a hooked upper end of said hanger with said supporting structure so as to suspend said hanger therebelow;

locating a flexible end of said flexible article between opposing first and second halves of a lower generally horizontal end of said hanger;

looping said flexible end of said flexible article over said first half; and locating a portion of said flexible end of said flexible article between said opposing first and second halves so as to suspend said flexible article.

* * * * *